United States Patent [19]

Balzano

[11] Patent Number: 5,056,661

[45] Date of Patent: Oct. 15, 1991

[54] TOOL CADDY

[76] Inventor: Alfiero Balzano, 11762 (O) Western Ave., Stanton, Calif. 90680

[21] Appl. No.: 597,568

[22] Filed: Oct. 15, 1990

Related U.S. Application Data

[63] Continuation-in-part of Ser. No. 338,763, Apr. 17, 1989, and a continuation-in-part of Ser. No. 180,233, Apr. 11, 1988, abandoned.

[51] Int. Cl.[5] ..... B65D 85/28

[52] U.S. Cl. ..... 206/372; 224/901; 224/183; 224/247; 224/904; 224/219; 206/350; 206/379; 211/70.6; 211/DIG. 1

[58] Field of Search ..... 224/901, 904, 247, 183, 224/219; 206/379, 372, 350; 211/70.6, DIG. 1

[56] References Cited

U.S. PATENT DOCUMENTS

| | | | |
|---|---|---|---|
| 1,701,057 | 2/1929 | Thatcher | 224/221 |
| 1,814,887 | 7/1931 | Bender | 224/247 |
| 1,927,110 | 9/1933 | Bannister et al. | 206/379 |
| 2,824,681 | 2/1958 | Sorkin | 224/183 |
| 2,844,244 | 7/1958 | Hanson | 206/379 |
| 3,058,504 | 10/1962 | Powers | 224/183 |
| 4,508,221 | 4/1985 | Olson | 206/379 |
| 4,690,316 | 9/1987 | Peterson | 224/904 |
| 4,733,809 | 3/1988 | Pursell | 224/901 |
| 4,797,040 | 1/1989 | Hibbard | 206/379 |
| 4,826,059 | 5/1989 | Bosch et al. | 224/901 |

*Primary Examiner*—Linda J. Sholl
*Attorney, Agent, or Firm*—Roger A. Marrs

[57] ABSTRACT

A tool caddy is disclosed herein for releasably retaining a plurality of hand tools and hand tool accessories, which includes a base having a plurality of resilient retainers mounted thereon adapted to snap-lock with tools or accessories. An attachment device is carried on the base for detachably mounting the caddy to the wrist, belt or tool so that the accessories are readily available to the user during a work procedure. The attachment device may take the form of a hook and pile fastener directly carried on the base or carried on the ends of a strap. A belt loop is also contemplated as an attachment device.

1 Claim, 2 Drawing Sheets

TOOL CADDY

This application is a continuation-in-part of applications Ser. Nos. 07/338,763, filed Apr. 17, 1989, pending and 07/180,233, filed Apr. 11, 1988, now abandoned.

BACKGROUND OF THE INVENTION

1. Field of the Invention

The present invention relates to tool caddies and more particularly to a novel caddy for releasably holding a plurality of tools and/or tool accessories such as drill bits, sockets, extensions or the like on a base or in a box which may be readily carried from place to place at the job site so that such tools or accessories are convenient for use by the workman.

2. Brief Description of the Prior Art

In the past, it has been the conventional practice for a workman to carry hand tools from place to place on the job site in a large toolbox or on a belt carried on his waist. Such a box and belt are generally satisfactory for large hand tools such as power drills, wrenches, large screwdrivers or the like. However, problems and difficulties have been encountered when a workman is performing a work procedure in a difficult location such as on a roof, on scaffolding or the like where heavy toolboxes cannot be carried and weighted waistbelts are a danger and an encumbrance. In many instances, once the workman is at the immediate job site in a remote area, it is necessary for him to change tool bit sizes, have a need for a different socket size, or he may require a smaller screwdriver or other hand tool. In such an instance, the workman must now retrace his steps back to wherever the heavy toolbox is located for selection of the proper tool or accessory. In some instances, in order to avoid such a protracted working procedure, the workman can take a variety of elements or accessories and put them in his pocket for selective use at the remote job site. In this latter instance, this may be satisfactory in getting small implements and accessories to the remote site for selection, but the workman must now reach into his pocket and pull out all of the accessories and place them on a flat surface so that he can select the proper tool or accessory to be used. In this instance, the tools or accessories are not captured so that they may easily be lost or dropped during the selection process.

Therefore, a long standing need has existed to provide a means for holding a variety of small hand tools and accessories so that the implements can be carried to the job site for use and to be carried in such a manner that the various implements and accessories are releasably held to a base or box so that selection is made easy and loss of such implements or accessories greatly reduced.

SUMMARY OF THE INVENTION

Accordingly, the above problems and difficulties are obviated by the present invention which provides a novel means for releasably storing a variety of small hand tools and accessories so that the workman can carry them from place to place so that the implements and accessories will be available for use at the immediate job site even in remote and difficult work locations. In one form of the invention, the means includes a base or box having a plurality of resilient snap fasteners arranged in rows and columns so a to removably accept the small implements and accessories in a predetermined arrangement so that the tools are placed in a particular order visually observable by the user. Attachment means for securing the base or box to the workman may be by belt loop, wrist strap or hook and pile attachment means. In another version, the base or box can be attached directly to the side of an associated work tool such as a drill housing or the like so that the implements and accessories are convenient to the tool intended to use the accessories.

Therefore, it is among the primary objects of the present invention to provide a novel tool caddy for storing a plurality of small hand tools and accessories in releasable resilient clamps so that the workman can carry the assemblage of implements and accessories into remote working locations.

Another object of the present invention is to provide a novel tool caddy permitting a workman to carry a variety of small hand tools and accessories from place to place in difficult work locations wherein the implements and accessories are retained in a releasable clamp ready for use by the workman at his selection.

Still another object of the present invention is to provide an inexpensive and convenient means for holding a variety of small implements and tool accessories that may be readily carried on the belt of the workman, the wrist of the workman or on the body of a larger and heavier hand tool associated with the accessories.

Yet another object of the present invention is to provide a simplified means for retaining a plurality of tool accessories in a convenient location for selection by a workman at a difficult work site such as in an elevated building, close quarters or at a substantial distance from a base of operations where a larger and heavier box is located.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
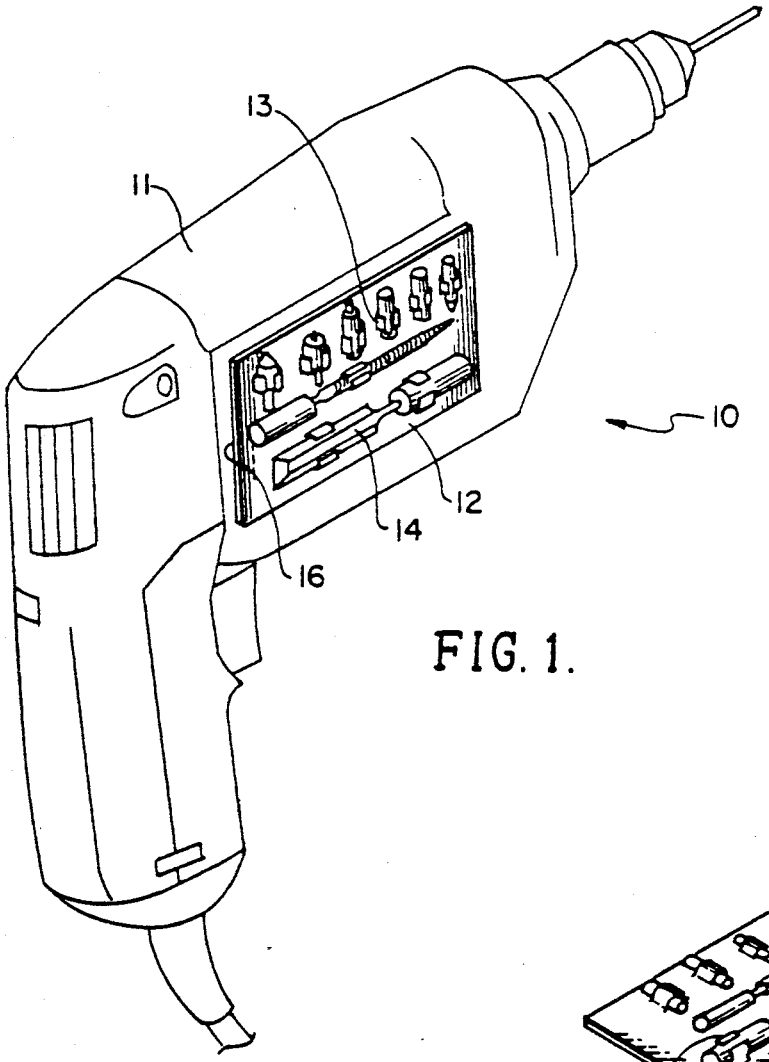
FIG. 1 is a perspective view showing a typical hand tool having the novel tool caddy attached to the side thereof in accordance with the present invention.

Referring to FIG. 1, the novel tool caddy of the present invention is shown in the general direction of arrow 10 wherein the caddy is attached to the side of a conventional hand drill 11. The caddy includes a flexible base 12 having an external surface on which a plurality of spring clips, such as indicated by numeral 13, are exposed. The clips are used by themselves or in combination to insertably attach with a variety of small hand tools or accessories. In the present illustration, a tool is indicated by numeral 14 which is held by a pair of spring clips. The spring clips serve as retainers and the tools are removably placed into the cavity of the clips by pushing through biased clip elements.

The caddy base 12 is attached to the side of the drill 11 by means of a hook and pile fastening arrangement collectively indicated by numeral 16. Also, it can be seen that the spring clip 13 comprises a pair of clip elements which are normally biased towards one another so that upon the insertion of a tool or accessory, the elements are spread apart and return to hold the tool in position.

Although a pair of hook and pile fasteners 16 is shown, it is to be understood that a single hook and pile fastener can be used. The hook portion of the fastener is adhesively attached to the side of the drill 11 while the pile portion of the fastener is adhesively attached to the backside of the base 12.

Figure 2:
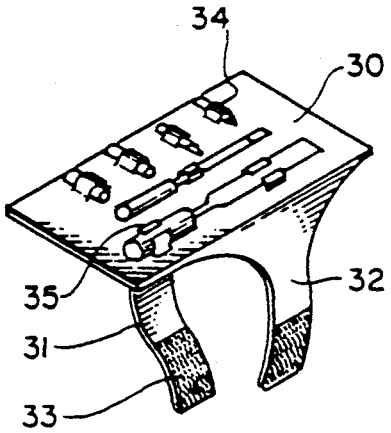
FIG. 2 is a perspective view of another version of the present invention wherein the novel tool caddy may be carried on the wrist of the workman.

Referring now in detail to FIG. 2, another embodiment of the invention is shown wherein the base is releasably secured to the wrist of the workman by means of straps 31 and 32 which are wrapped about the wrist and coupled together by a hook and pile fastening means 33.

The base is a sheet of material 30 having straps 31 and 32 suitable for wrapping about the wrist of the user. The hook and pile fastener 33 is used for joining the ends of the strap together so that the sheet 30 is carried on the wrist. On the external side of the sheet 30, there is provided a plurality of loops or spring retainers for holding a plurality of tools or accessories. Such a loop is indicated by numeral 34 while a spring retainer is indicated by numeral 35.

Figure 3:
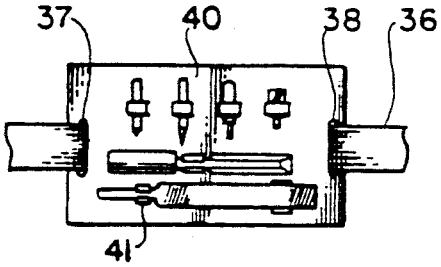
FIG. 3 is a plan view of the tool and the tool caddy shown in FIG. 2.
Figure 4:
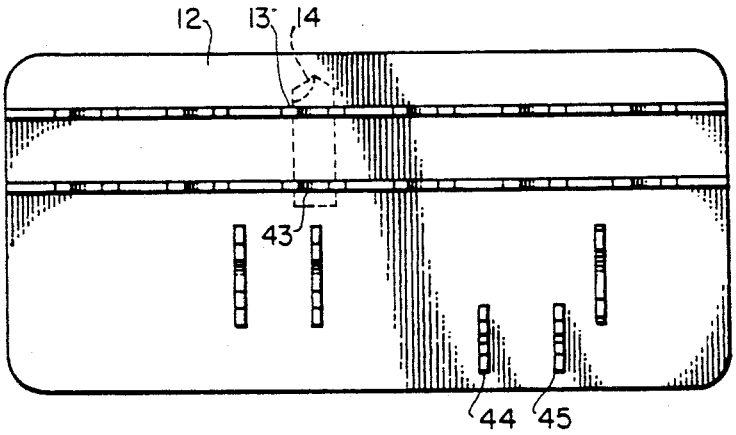
FIG. 4 is a plan view of the inventive tool caddy wherein the base is a thin flexible sheet, as shown in FIG. 1.
Figure 6:
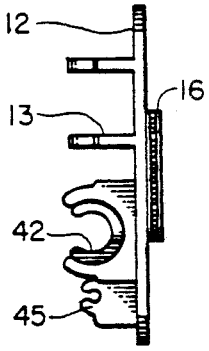
FIG. 6 is an end elevational view of the version of tool caddy shown in FIG. 4.

Referring now to FIG. 3, still another version of the invention is illustrated which may be readily attached to a belt 36 by inserting the belt through openings 37 and 38 in a sheet 40. The plurality of loops or spring retainers, such as spring retainer 41, are carried on the external surface of the sheet so that a variety of implements and accessories are available for use by the workman.

Figure 5:
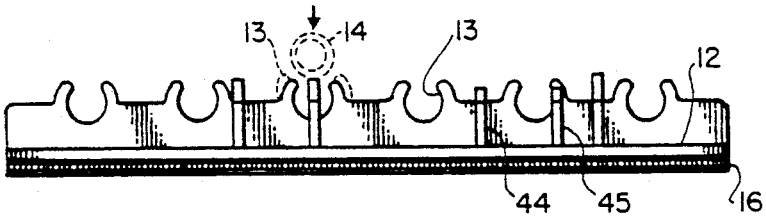
FIG. 5 is a side elevational view showing the version of FIG. 4.
Figure 7:
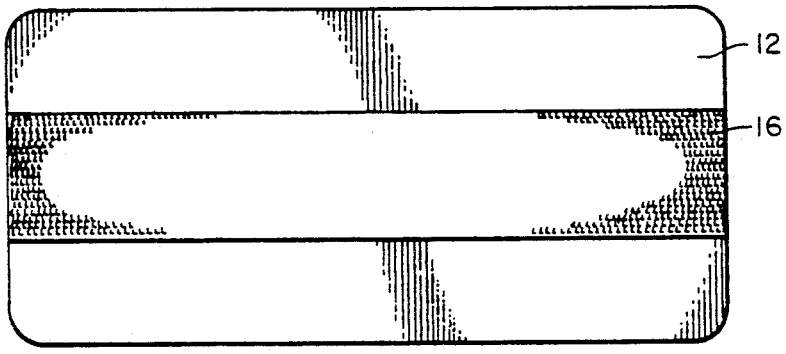
FIG. 7 is a bottom view showing a hook fastener to be engaged by a pile element or an adhesive fastener.

FIGS. 4–7 inclusive illustrate the caddy having the base 12 with clip elements 13 shown expanded to receive the tool 14 in broken lines (FIG. 5). In the event sharp edged tools are being carried, a protective insert or liner 42 (FIG. 6) may be installed on a clip element. The base is flexible and no cover or lid is necessary since the full view of all tools to the workman is needed.

In view of the foregoing, it can be seen that a variety of implements can be placed in a convenient location for use by the workman. The workman can insert selected implements and accessories into the various loops and retainers on any one of the embodiments of the invention and the tool caddy can then be carried on the person in an organized manner ready for use at a remote job site. A contoured support taking the form of a belt or clothing worn by the workman may support the caddy. The attachment means 16 conforms to the contoured support. The cloth of the workman's pants may be the pile portion of the hook and pile attachment arrangement.

The liner 42 may be composed of magnetic material so that a magnetic attraction is produced to draw and hold a metallic bit or accessory into releasable engagement with the jaws 13. Furthermore, the shank or body of the tool bit may be provided with spaced-apart grooves 43 and 43' for receiving the spring clips ro jaws 13. This construction provides more exposed surface area for the clips or jaws to engage. The grooves match the spacing of the caddy clips or jaws. A typical spaced apart pair of cooperating clips is indicated by numerals 44 and 45 in FIG. 4. The composition is plastic which has a self biasing condition to bring the ends of the clips towards each other.

Figure 8:
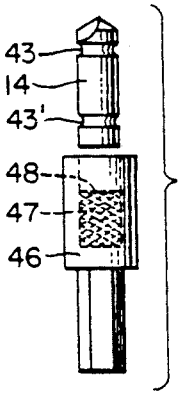
FIG. 8 is an exploded side elevational view of the tool implement and a tool holder.

FIG. 8 illustrates the bit with grooves and shows a tool holder 46 having a receptacle 47 partially occupied with a magnetic material so that the magnetic field releasably holds the bit within the receptacle.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a tool caddy for releasably retaining a variety of hand tool implements and accessories on a contoured support comprising the combination of:

an elongated base sheet of flexible and bendable material having a top externally and visibly exposed flat surface;

retaining means fixedly carried on said flexible base sheet flat surface in spaced-apart relationship for removably holding small hand tool implements and accessories thereon;

said retaining means including a plurality of pronged clips outwardly projecting from said base sheet flat surface and each clip of said plurality having resilient prong elements defining a yieldable wedge entrance for insertably receiving said tool implements and accessories for frictional retention on said base sheet flat surface;

selected ones of said hand tool implements and accessories provided spaced-apart grooves aligned with aid spaced prong elements for insertably receiving said prong elements therein;

selected ones of said pronged clip elements arranged in linear spaced-apart pairs so as to combine and cooperate in the retention of said tool implements and accessories;

a contoured support having an exposed shaped exterior surface for releasably supporting said bendable base sheet and visibly exposing said tool implements and accessories;

pliable attachment means of a hook and pile fastener type carried on a reverse surface of said base flat sheet for detachably mounting said base sheet including said hand tool and accessories onto said contoured support and being characterized as bendable in cooperation with said base flat sheet so as to conform with said contoured support;

selected ones of said clip prongs having insert protective means carried on each of said pair of prong elements as a barrier between an inserted tool implement and said prong element;

a selected number of pairs of prong elements are disposed normal to a non-selected number of prong elements; and said insert protective means being magnetic and carried on said prongs to generate magnetic flux loops releasably retaining said tools and accessories in combination with said resilient prong elements and said yieldable wedge.

* * * * *